US007238067B2

(12) United States Patent
O'Connor

(10) Patent No.: US 7,238,067 B2
(45) Date of Patent: Jul. 3, 2007

(54) VARIABLE AREA PUMP DISCHARGE SYSTEM

(76) Inventor: Brian J. O'Connor, 614 Ocean View Ave., Encinitas, CA (US) 92024-2630

( * ) Notice: Subject to any disclaimer, the term of this patent is extended or adjusted under 35 U.S.C. 154(b) by 0 days.

(21) Appl. No.: 11/103,318

(22) Filed: Apr. 11, 2005

(65) Prior Publication Data

US 2006/0228958 A1 Oct. 12, 2006

(51) Int. Cl.
*B63H 11/103* (2006.01)

(52) U.S. Cl. ..... 440/47; 440/38

(58) Field of Classification Search ..... 440/38, 440/40–43, 47; 60/221, 222
See application file for complete search history.

(56) References Cited

U.S. PATENT DOCUMENTS 2,112,948 A * 4/1938 Anderson ..... 60/221
2,149,155 A * 2/1939 Anderson ..... 440/47
3,046,697 A * 7/1962 Pullen ..... 446/164
3,183,878 A * 5/1965 Aschauer ..... 440/38
3,214,903 A 11/1965 Cochran
3,279,704 A 10/1966 Englehart et al.
3,286,641 A 11/1966 Delao et al.
3,424,121 A 1/1969 Thomas et al.
4,030,442 A * 6/1977 White ..... 440/41
4,144,041 A 3/1979 Hou
4,176,616 A 12/1979 Robins
4,231,315 A 11/1980 Tachibana et al.
4,718,870 A 1/1988 Watts
5,244,425 A 9/1993 Tasaki et al.
5,338,234 A 8/1994 Nanami
5,542,863 A 8/1996 Brian et al.
5,634,831 A 6/1997 Davies et al.
5,658,176 A 8/1997 Jordan
5,692,371 A 12/1997 Varshay et al.
5,863,229 A 1/1999 Matte
6,004,173 A 12/1999 Schott
6,024,614 A 2/2000 Burg
6,027,383 A 2/2000 Broinowski
6,193,569 B1 2/2001 Davies et al.
6,193,570 B1 2/2001 Ishigaki
6,193,571 B1 2/2001 Burg
6,293,836 B1 9/2001 Blanchard

* cited by examiner

*Primary Examiner*—Sherman Basinger
(74) *Attorney, Agent, or Firm*—Fulwider Patton LLP

(57) ABSTRACT

A highly efficient watercraft propulsion system that operates continually submerged and relies on a non-circular variable area pump discharge opening which is configured, positioned and oriented so as to maximize the hydraulic reaction between the high velocity water jet stream and the surrounding body of water and is driven by a positive displacement pump.

10 Claims, 5 Drawing Sheets

VARIABLE AREA PUMP DISCHARGE SYSTEM

FIELD OF THE INVENTION

Background of the Invention

The present invention generally relates to water jet propulsion devices and more particularly pertains to devices for varying the area of an orifice through which a water jet is discharged.

It is well known that the velocity with which a water jet is discharged from a watercraft relative to the velocity of the watercraft has a direct effect on the efficiency of such a system. Propulsion efficiency, whether measured with respect to fuel consumption or vessel speed, is a function of both water jet discharge velocity and volumetric flow. While the water jet discharge velocity can of course be controlled by pump's volumetric output, the jet velocity can also be controlled by varying the cross-sectional area of the orifice through which the water is discharged. Accordingly an increase in the cross sectional area of the discharge orifice for a given pump output reduces the water discharge velocity while a decrease of the cross-sectional area serves to increase said velocity.

It has been long recognized that the ability to vary discharge orifice area can significantly enhance propulsion efficiency over a wide range of operating conditions and thereby reduce fuel consumption. A large variety of configurations that are either cylindrical, conical, hemispherical or combination of same have been suggested for a discharge orifice that is variable in terms of both area and flow path shape along with various mechanisms to control the water discharge velocity as a function of any of various parameters. Even greater efficiency would nonetheless be desirable.

SUMMARY OF THE INVENTION

The present invention provides a highly efficient pump discharge system that controls the dynamics of a submerged water jet employed to propel a watercraft. More particularly, the system includes a duct having a discharge opening configuration that is continuously variable in terms of its cross-sectional area. Said discharge employs an opening having cross-sectional shape that is substantially trapezoidal. The sides of the discharge opening transverse to the parallel sides are straight or curved and may be substantially parallel so as to define a rectangle. Additionally, the discharge duct is positioned on the submerged portion of the watercraft hull so that the pump discharge flow is ejected into the surrounding water thereby creating a direct hydraulic coupling to thereby enhance thrust efficiency.

On vessels that generally have a flat bottom, the discharge opening of the duct may generally define a horizontally oriented tapered trapezoidal duct. On large vessels, several ducts may be installed at various orientations on the submerged portion of the curved hull. A contoured or generally wedge-shaped control element is movably disposed within the duct such that its narrow end is variably extendible out through the exit of the discharge opening. The control element thereby serves to block off a central portion of the discharge opening to reduce the total cross-sectional area that remains open to the flow of water there through. Its wedge shape serves to block off a progressively larger portion of the discharge opening's cross-sectional area as the control element is caused to translate out through the discharge opening which in turn results in an increase in the water jet velocity. Conversely, retraction of the control element serves to increase cross-sectional area to thereby reduce water jet velocity.

The linear position of the wedge-shaped control element may be translated by any number of actuation means including, but not limited to, mechanical, hydraulic, or servo electronic systems or combinations thereof. A variety of different control means may also be relied upon to govern the position to which the control element is actually shifted including, but not limited to, manual selection, direct action of pump output or more sophisticated systems such as for example a microprocessor that considers a plurality of parameters and calculates an optimum setting. A preferred embodiment simply relies on the action of a spring to bias the control member into its retracted position. As the force of the flow of water impinging on the frontal surfaces of the control element is increased by an increase in the volumetric pump output, the bias of the spring is overcome to cause the control element, which is constrained vertically between the upper and lower, parallel surfaces of the discharge duct, to shift linearly towards the discharge opening thereby causing a further increase flow velocity.

The location and orientation of the discharge opening serves to further enhance the propulsion efficiency of the water jet discharge system of the present invention. Accordingly, the discharge opening is positioned so as to remain submerged at all times to create a direct hydraulic reaction between the discharge jet and the surrounding body of water. By positioning the discharge opening so as to extend from the bottom of the hull at a location substantially forward of the trailing edge of the hull, the section of hull aft of the discharge opening in the plane of the upper surface of the duct prevents the upward diffusion of the jet. Additionally, an extension of the duct's bottom surface aft of the discharge opening limits the amount of outward diffusion of the jet in the plane of the lower surface of the duct. By constraining the discharged jet between the hull and the duct extension aft of the discharge opening, a greater portion of the discharge flow is constrained so as to remain substantially parallel to the direction of desired thrust i.e. in-line with the direction of travel. The result is an increase in axial thrust, or vessel driving force, than if the pump discharge is allowed to diffuse freely.

While the positioning of the pump discharge opening below the hull of a watercraft has been found to increase the effectiveness of the discharging jet of water, it is important that the discharge housing be shaped so as to minimize the hydrodynamic impact of its presence in such a critical location. The partially hemispherical shape of the exterior surface of the discharge duct serves to minimize the dynamic drag profile that extends beyond the uniform surface of the hull and a smooth blend of the intersecting surfaces between the duct and the surrounding hull surface promotes laminar flow over and around the entire surface to thereby minimize fluid dynamic drag.

Finally, in order to maximize the efficiency of the discharge system of the present invention it is necessary to supply sufficient volumetric flow and pressure head to the upstream side of the discharge duct so that the discharge volume flow can maintain the most efficient velocity ratio between the discharge jet and the adjacent water body in order to maximize the hydraulic reaction at the plane of the discharge opening and within the liquid mixing zone. Because of the aforementioned pressure head requirement, it is preferred that a positive displacement pump be relied upon to generate the flow of water. Any of a variety of positive displacement pumps can be utilized including for example, configurations employing sliding vanes, intermeshing gears, gerotors or Moineau-type designs which all have high pump efficiency over a wide range of rotor speed. The pumps can in turn be driven by any type of powerplant including for example internal combustion engines and electric motors.

These and other advantages of the present invention will become apparent from the following detailed description of preferred embodiments which, taken in conjunction with drawings, illustrate by way of example the principles of the invention.

DETAILED DESCRIPTION OF THE INVENTION

The pump discharge system of the present invention provides for the enhanced efficiency of a water jet such as is used for the propulsion of a watercraft. The figures generally illustrate preferred embodiments of the discharge system in terms of its configuration, the mechanism for varying the cross-sectional area of the discharge opening and its positioning with respect to the watercraft.

Figure 1:
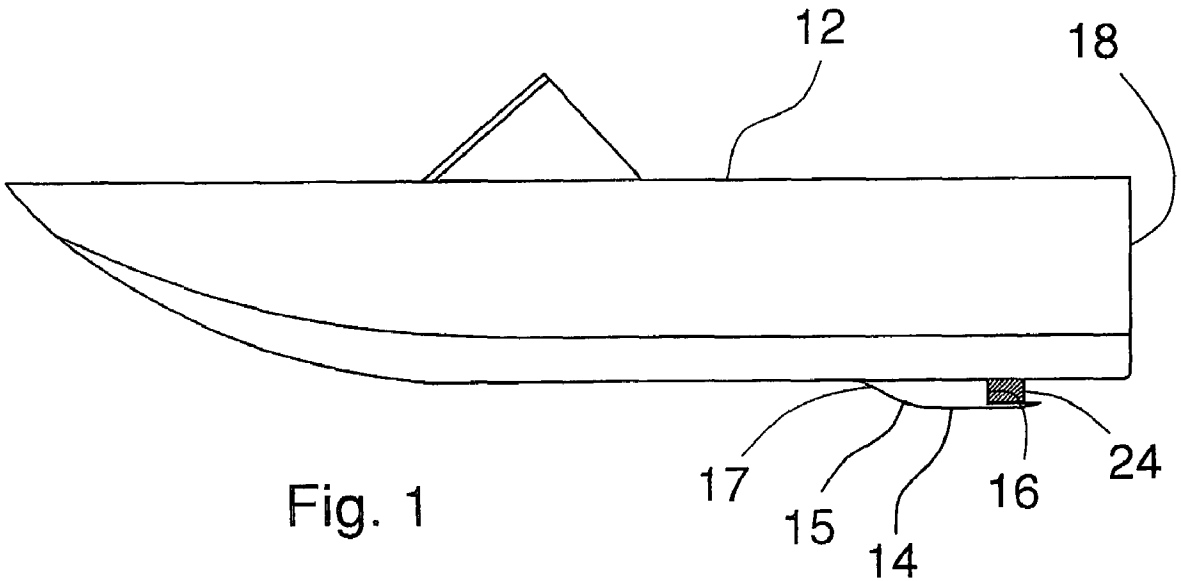
FIG. 1 is a side view of a flat bottom, non-descript boat hull showing the general shape and typical location of the discharge duct of a preferred embodiment of the variable area discharge system of the present invention extending from bottom surface of the hull.

FIG. 1 is a side view of a watercraft 12 showing the hull bottom that has been fitted with the discharge system of the present invention. The discharge housing 14 is positioned under the hull so as to ensure that the discharge opening 16 remains submerged at all times during all modes of operation. Its submersion even under maximum acceleration from low speeds or at maximum velocity ensures that the hydraulic reaction between the liquid jet stream and the adjacent, relatively static body of water can be maximized at all times. As can be seen in the FIG. 1, the discharge opening is positioned well forward of the aft edge 18 of the hull. The leading surface of the discharge housing is a generally spherical contour 15 that is blended with a smooth radius 17 along its transition into the hull.

Figure 2:
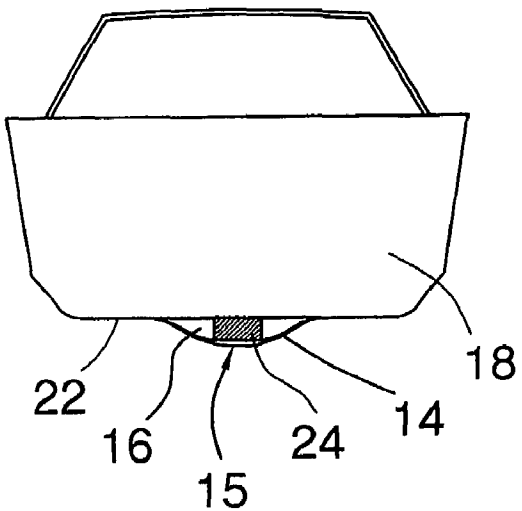
FIG. 2 is the rear view of the preferred embodiment shown in FIG. 1.

FIG. 2 is a rear end view of a watercraft that has been fitted with the discharge system of the present invention. The discharge housing 14 is shown centered on the bottom surface 22 of the hull with the continuation of the generally spherical frontal contour 15 extending along the bottom surface of the housing 14. The control element 24 and the discharge opening 16 are also clearly illustrated.

Figure 3:
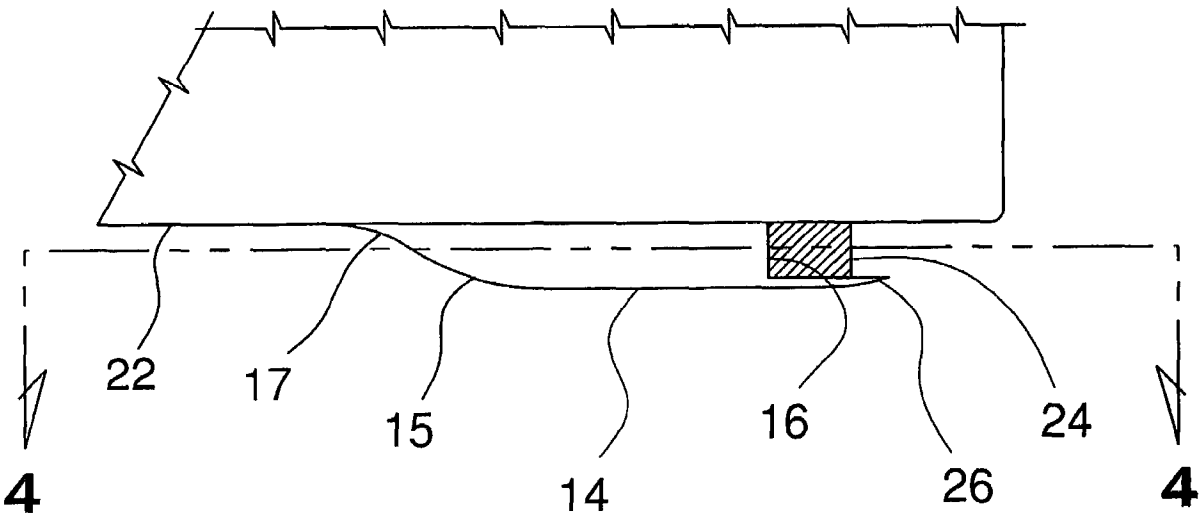
FIG. 3 is an enlarged side view of the discharge duct shown in FIG. 1.

FIG. 3 is an enlarge side view of the discharge housing 14 extending from the bottom of the hull 22. Its leading surface 15 is blended into the surrounding hull with a blend radius 17 while its aft end in the region of the discharge opening 16 defines a substantially vertical cut through the contoured end. A movable control element 24 with which the cross-sectional area of the discharge opening 16 is alterable is seen protruding from the discharge opening. Additionally visible is a bottom lip 26 that extends beyond the discharge opening from the bottom surface of the discharge housing.

Figure 4:
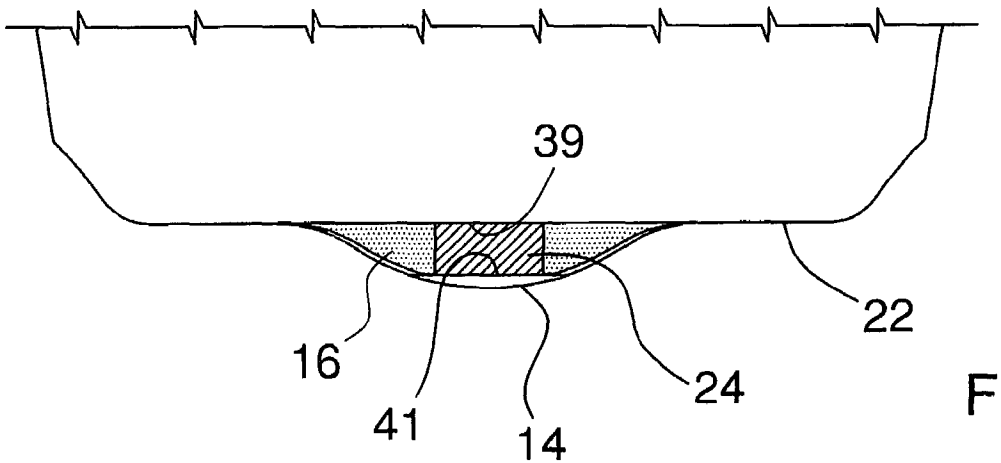
FIG. 4 is an enlarged rear view of the discharge duct shown in FIG. 2.

FIG. 4 is an enlarged rear view of the discharge housing 14 extending from the bottom of the hull 22. Clearly visible is the movable control element 24 that is centrally positioned within the non-circular discharge opening 16 and the parallel upper and lower control surfaces, 39 and 41 respectively, on which the control element slides.

Figure 5:
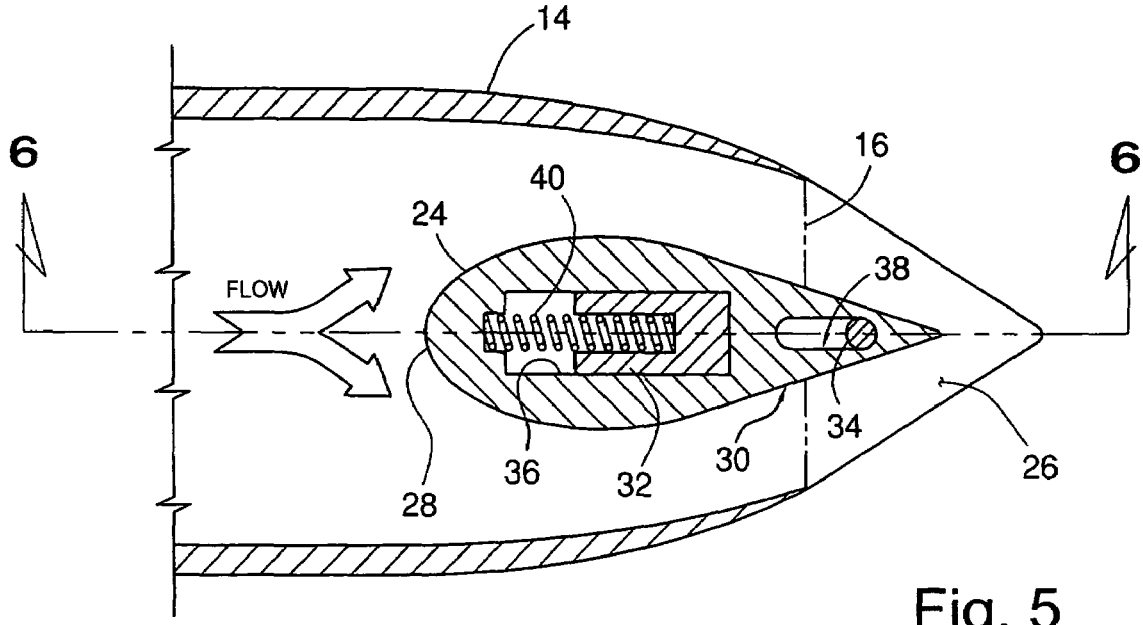
FIG. 5 is a further enlarged cross-sectional view taken along line 4—4 of FIG. 3 showing the control element in its fully retracted position.

FIG. 5 is a further enlarged cross-sectional view taken along lines 4—4 of FIG. 3. The movable control member 24 is centrally disposed within the discharge housing 14 and includes a forward section 28 that defines a smoothly curved surface that serves to split and divert the flow of water around the control member. The aft section 30 of the control member generally defines a wedge shape in cross-section. The control member is shown in its fully retracted position wherein only a small portion of the wedge-shaped end extends outwardly beyond the discharge opening 16. In such position, the control member blocks off the least amount of the total cross-sectional area of the discharge opening to thereby maximize the amount of cross sectional area through which the flow of water is discharged.

Additionally shown in FIG. 5 is a guiding member 32 and a guide pin 34 which is accommodated in respective slots 36, 38 formed in the control member. Such elements serve to constrain the movement of the control member so as to be moveable only along the longitudinal axis of the control member 24 and additionally serve to limit the maximal amount of extension as well as retraction. Additionally, these elements can be relied upon to support the bottom surface of the discharge duct 14 as well as the bottom lip 26 and prevent deformation of the respective components when subjected to high pressure differentials between the internal region of the discharge housing and surrounding water body. The particular embodiment shown in these drawings relies on a compression spring 40 to bias the control member into its fully retracted position. The spring rate of the spring is selected so as to allow the control member to extend rearwardly at a linear rate as the water flow from the pump increases, corresponding to a predictable linear position resulting in the desired discharge flow area. A variable rate spring may also be used to provide alternate positioning of the control member at comparable pump flowrates.

Figure 6:
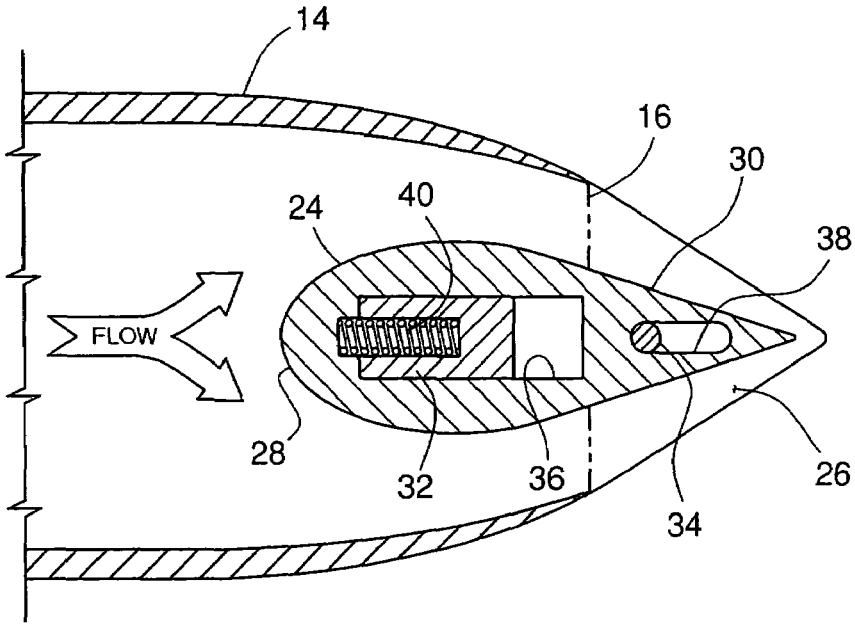
FIG. 6 is a cross-sectional view similar to that shown in FIG. 5 but with the control element in its fully extended position.

FIG. 6 illustrates the control member 24 in its fully extended position in reaction to the force exerted on the leading surfaces of the forward section of the control member by the flow of water generated by a pump (not shown) upstream of the discharge duct 14. The stationary guiding member 32 and guide pin 34 serve to prevent lateral deflection of the control member and upon contact with the proximal ends of the respective slots 36, 38, limit its movement rearwardly. The guide pin 34 also prevents downward deformation or deflection of the bottom lip 26 potentially caused by the pressure exerted thereon by the discharging jet.

Figure 7:
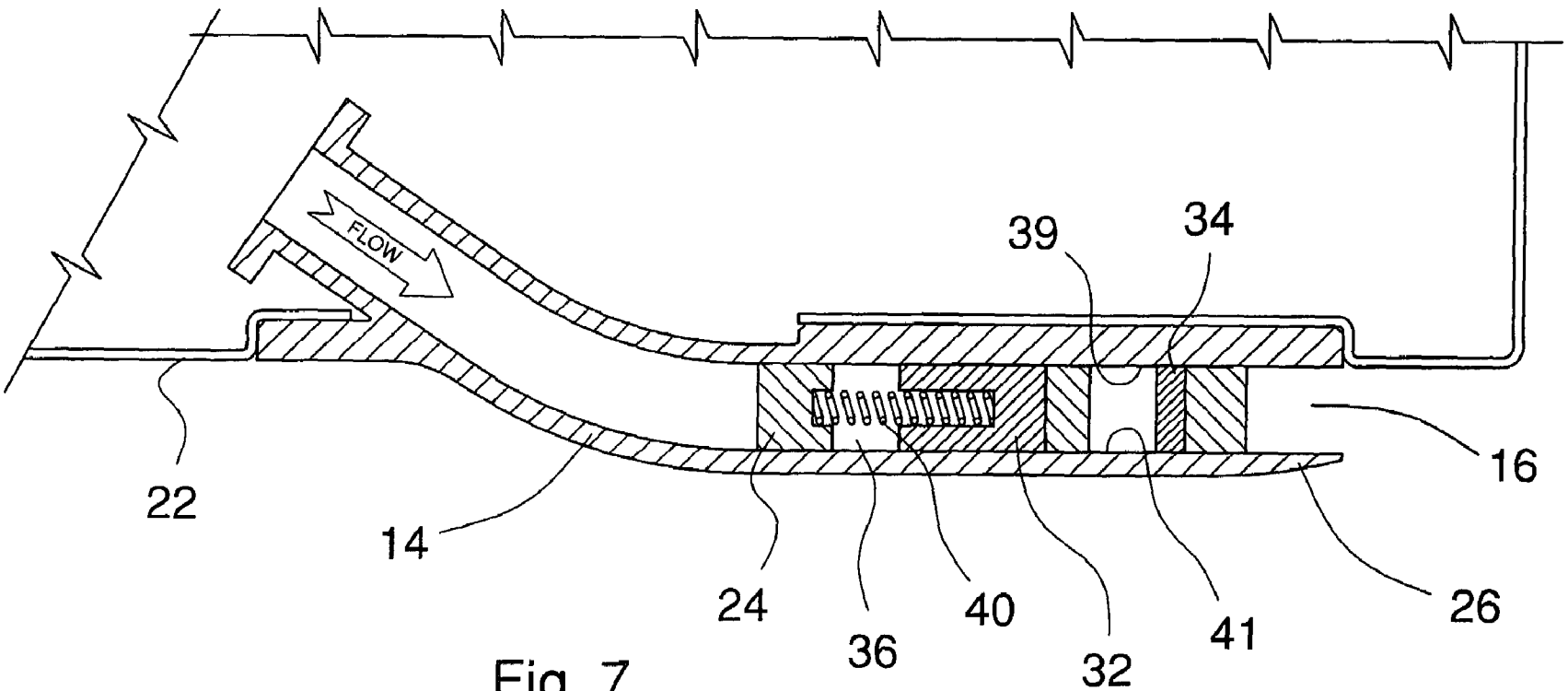
FIG. 7. is a longitudinal cross-sectional view of the discharge system of the present invention taken along lines 6—6 of FIG. 5.

FIG. 7 is a cross-sectional view taken along lines 6—6 of FIG. 5. The illustration clearly shows the positioning of the discharge opening 16 and a portion of the discharge duct 14 below the hull 22 of a watercraft. Flow is generated by a pump that is not shown that may be positioned at relatively remote forward location with respect to the discharge duct. Additionally visible in this Figure is the interconnection between parallel surfaces 39 at the top of the duct and 41 at the bottom of the duct and guide pin 34. The guide pin as well as the stationary guiding element 32 serve to stabilize the bottom surface 41 of the duct and the bottom lip 26 preventing possible deformation caused by hydraulic forces. Deflection and/or deformation of the bottom surface 41 of the duct could impair the smooth actuation of the control element 24 as well as allow the flow of water between the control element 24 and either the top 39 or the bottom surface 41 of the duct. Additionally, deflection of the bottom lip 26 would compromise its ability to prevent downward diffusion of the discharged water jet.

Figure 8:
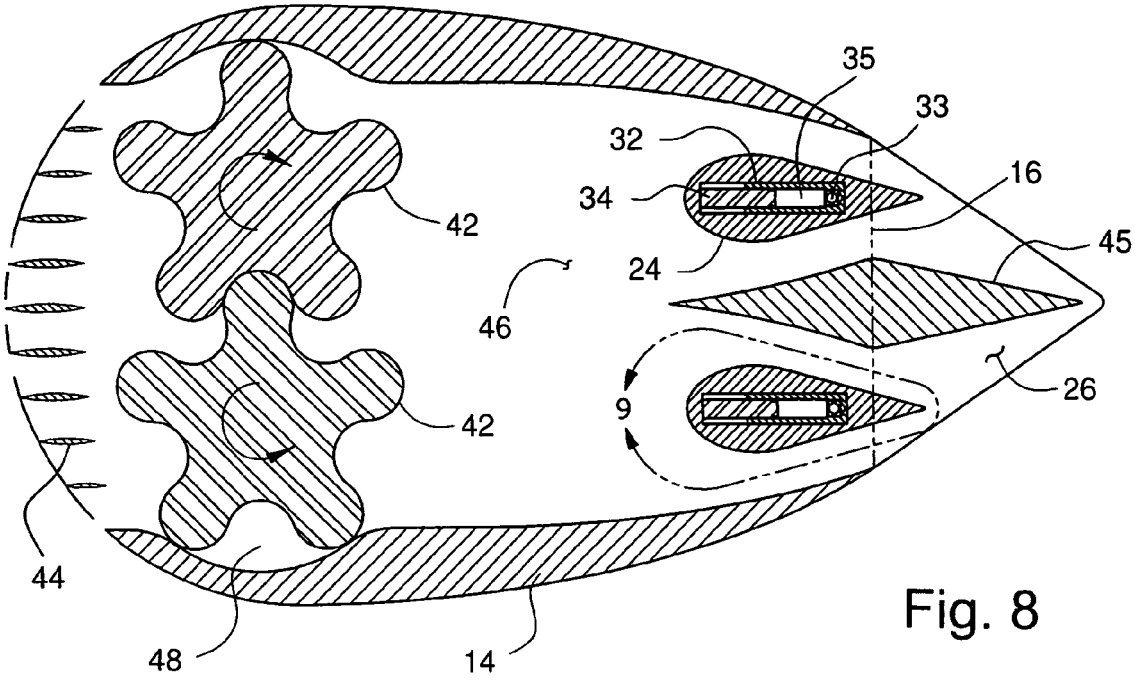
FIG. 8 represents of a planar cross-sectional view, similar to the section view along line 4-4 in FIG. 3, of another preferred embodiment of the discharge system of the present invention employing a dual rotor lobe pump and dual control members.

FIG. 8 illustrates a preferred embodiment of the present invention wherein a positive displacement pump and more specifically, a dual rotor multiple lobe positive displacement pump 42 is relied upon to generate a flow of water past the control element 24 which is illustrated in the fully retracted position and through discharge opening 16. The individual rotors are arranged so as to rotate about parallel axes that can be vertical as shown or tilted with respect to the horizontal plane. The rotors may be driven by a single powerplant or by multiple power plants. A dual lobe pump configuration is preferred because the rotor lobes while acting to positively displace the water, never actually touch the housing surface thus eliminating wear and it is fully reversible allowing reverse thrust. Forward vessel thrust is provided by the counter-rotation of the rotors 42 whose rotational direction is indicated by the superimposed rotation arrows drawing water into the upstream side of the pump passing through a structural grille 44, and is accelerated within the transport pocket 48 and thereafter forced toward the control member 24 within the discharge housing 14. Axial force from the impact of the moving water on the frontal surface of the control member 24 causes the body of the member to move aft. This embodiment of the invention uses a hydraulic piston 34 to position the control member 24 variably from its fully retracted to its fully extended position shown in FIG. 9 depending on the volume of hydraulic fluid supplied via the feed port 33 to the piston chamber 35. The piston is contained in the guide element 32 that extends from the upper to lower surface 46 of the discharge housing. Structural support for the housing bottom surface 46 and the lip extension 26 is supplied by the guide element 32 and the center guide vane 45. While The pumps may driven by any type of powerplant including for example the ubiquitous internal combustion engine or by an electric motor.

Figure 9:
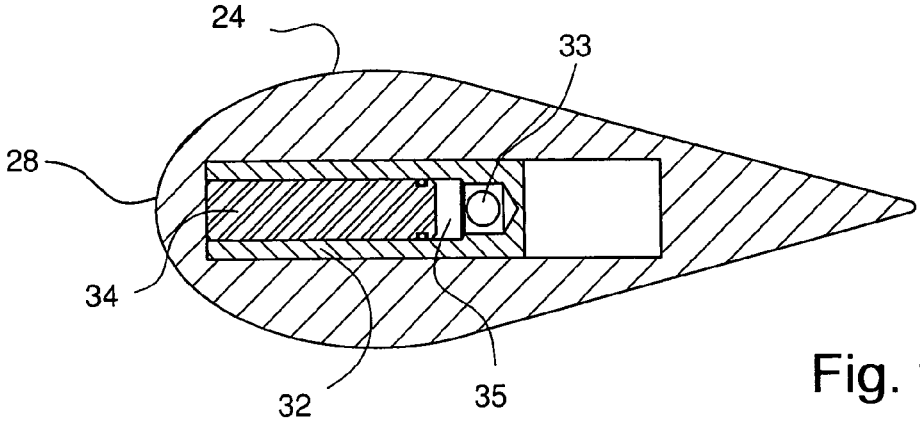
FIG. 9 is an enlarged view of encircled region 9 shown in FIG. 8 illustrating a single control member in the fully extended position where the axial translation aft is determined by the position of the internal hydraulic piston.

FIG. 9 is an enlarged view of encircled area 9 of FIG. 8 illustrating a single control element 24 in the fully extended position. While the force to move the control member aft is supplied by the impact of the pump flow on the forward surface 28 of the control element, its precise axial location is fixed by the axial location of the piston 34 that is contained within the guide element 32 wherein passage 33 allows hydraulic flow to and from chamber 35 to establish the axial location of the control element 24.

In operation, reliance on a positive displacement pump in conjunction with a fully submerged-discharge-opening having a variable cross-sectional area combine to yield extremely high propulsion efficiency over the entire range of pumping capacity. Adjustment of the cross-sectional area of the discharge opening allows the discharge jet velocity to be set to propel a vessel at its best fuel efficiency or, if desired, to provide maximum driving force over a wide range of vessel operating parameters such as weight, displacement and weather conditions. The submerged variable area discharge opening in combination with the installation location on the hull and a bottom lip serve to limit diffusion of the water jet thereby minimizing the dynamic mixing losses aft of the discharge plane 16 allowing the hydraulic reaction to be maximized. Finally, the use of a positive displacement pump allows sufficient pressures to be generated and maintained so that the desired jet velocities can be attained to create the most effective hydraulic reaction between the liquid discharge and the surrounding body of water. An overall performance increase can therefore be realized to the extent that thrust produced by the water jet over the full operating range of the pump output can be maximized. Accordingly, overall energy consumption can be significantly reduced as the water discharge velocity leaving the housing can be optimized at any given vessel speed to yield the highest possible propulsion efficiency using the least amount of fuel.

While particular forms of the invention have been described and illustrated, it will also be apparent to those skilled in the art that various modifications can be made without departing from the spirit and scope of the invention. Accordingly, it is not intended that the invention be limited except by the appended claims.

What is claimed is:

1. A water jet propulsion device for a watercraft, comprising:

a discharge duct for discharging a jet of water, wherein said duct defines a discharge opening that is positioned under said watercraft so as to be fully submerged at all times; and a movable element disposed within said discharge duct operative to vary the cross-sectional area of said discharge opening, and movable along a direction parallel with said jet of water, wherein said movable element is comprised of two flat, parallel surfaces and two opposing surfaces that define a wedge having an apex that is variably extendible from within said discharge duct outwardly through said discharge opening.

2. The water jet propulsion device of claim 1, wherein said watercraft includes a hull and wherein said discharge opening is positioned such that a discharged jet of water flows along a submerged portion of said hull.

3. The water jet propulsion device of claim 2, further comprising a lip that extends from said discharge duct beyond said discharge opening so as to define a surface substantially parallel to said hull along which said discharged jet of water flows.

4. The water jet propulsion device of claim 1, wherein said discharge opening has a cross section defining a generally trapezoidal slope wherein top and bottom sides are parallel and transverse sides may be straight or curved.

5. A water jet propulsion device for a watercraft, comprising:

a discharge duct for discharging a jet of water, wherein said duct defines a discharge opening that is positioned under said watercraft so as to be fully submerged at all times; and a movable element disposed within said discharge duct operative to vary the cross-sectional area of said discharge opening, wherein said movable element is moved toward the aft end of the vessel hull by force generated by a flow of water within said discharge duct impinging directly on said moveable element.

6. The water jet propulsion device of claim 5, wherein said force is resisted by a spring which biases said movable element into a predefined position.

7. The water jet propulsion device of claim 6, wherein said spring is positioned within said moveable element.

8. The water jet propulsion device of claim 7, wherein said spring has a non-linear spring rate.

9. The water jet propulsion device of claim 5, wherein said force is resisted by a hydraulic piston so as to position said movable element into predefined linear positions.

10. The water jet propulsion device of claim 5, wherein one or more additional movable elements are disposed within said discharge duct to vary the cross-sectional area of said discharge opening.

* * * * *